US005092119A

United States Patent [19]

Sarcia

[11] Patent Number: 5,092,119

[45] Date of Patent: Mar. 3, 1992

[54] METHOD AND APPARATUS FOR CONTROLLING THE MOVEMENT OF A FREE, GAS-DRIVEN DISPLACER IN A COOLING ENGINE

[76] Inventor: Domenic S. Sarcia, 114 Sunset Rd., Carlisle, Mass. 01741

[21] Appl. No.: 616,338

[22] Filed: Nov. 21, 1990

Related U.S. Application Data

[63] Continuation-in-part of Ser. No. 493,474, Mar. 14, 1990, Pat. No. 5,048,297.

[51] Int. Cl.[5] ..... F02G 1/06

[52] U.S. Cl. ..... 60/520

[58] Field of Search ..... 60/520; 62/6

[56] References Cited

U.S. PATENT DOCUMENTS 4,567,726 2/1986 Vitale et al. ..... 60/520

4,792,346 12/1988 Sarcia ..... 60/520 X

*Primary Examiner*—Allen M. Ostrager

*Attorney, Agent, or Firm*—Richard J. Birch

[57] ABSTRACT

A method and apparatus for controlling the reciprocal movement of a free, gas-driven displaced in a cooling engine are disclosed. Mechanical stops in the form of a crank mechanism prevent axial overshooting of the gas-driven displacer in each direction. A uni-directional magnetic "detent" is established for the displacer at predetermined location beyond the top dead center and bottom dead center portions of the cooling cycle. Each uni-directional magnetic "detent" provides a magnetic retention force to hold the displacer from moving until a pre-determined pressure differential is established across the displacer's drive piston. The magnetic "detents" are formed by magnetic elements that operate in cooperation with the crank mechanism. The magnetic retention forces can be made equal or unequal in magnitude through the selection of permanent magnet(s) or core configuration(s) or by controlling the field strength of electro-magnets or by varying the position of the magnets with respect to the TDC and BDC positions of the crank mechanism.

17 Claims, 9 Drawing Sheets

METHOD AND APPARATUS FOR CONTROLLING THE MOVEMENT OF A FREE, GAS-DRIVEN DISPLACER IN A COOLING ENGINE

CROSS-REFERENCE TO RELATED APPLICATION

The present application is a continuation-in-part application of application Ser. No. 07/493,474 filed Mar. 14, 1990 for Method and Apparatus for Controlling the Movements of a Free, Gas-Driver Displaces in a Cooling Engine by Domenico S. Sarcia and Richard J. Birch now U.S. Pat. No. 5,048,297. The disclosure of said application Ser. No. 07/493,474 is incorporated herein by reference.

BACKGROUND OF THE INVENTION

The present invention relates to cooling engines in general and, more particularly, to cooling engines having a free motion, gas-driven, piston actuated displaced.

Traditionally, free displaced, i.e., free piston cooling engines, work well thermodynamically, but lack sufficient reliability over a long period of time for them to be commercially successful against the currently available mechanical driven cooling engines. The problem with a free, gas-driven displaced is controlling the motion of the displaced at the top dead center and the bottom dead center of its cycle. In order to achieve high thermodynamic efficiency, the volumes at top dead center (TDC) and bottom dead center (BDC) should approach zero. With free displaced machines, this objective is very difficult to achieve without collisions taking place between the displaced and cylinder containing the displaced.

U.S. Pat. No. 4,792,346, issued Dec. 20, 1988, for a "Method and Apparatus for Snubbing the Movement of a Free, Gas-Driven Displaced in a Cooling Engine" discloses a method for snubbing displaced movement that utilizes a magnetic repulsion force between the displaced and each end of the cylinder containing the displaced. Two stationary magnets are placed at the ends of the displaced containing cylinder and the displaced itself has two movable magnets attached to the ends of the displaced in such a manner that they act as magnetic springs, i.e., the like magnetic poles of the stationary and movable magnets at one end face each other and, similarly, the like magnetic poles of the stationary and movable magnets at the other end of the displaced and cylinder face each other.

As the displaced approaches one end of the cylinder, the repulsion force of the magnetic force of the magnetic spring stores the kinetic energy of the displaced and prevents a collision from taking place. When the displaced is allowed to move in the other direction, the stored energy is converted back into kinetic energy in the opposite direction. Thus, the displaced is essentially suspended between the two magnetic repulsion forces which prevent collisions between the displaced and the ends of the displaced containing cylinder. The disclosure of U.S. Pat. No. 4,792,346 is incorporated herein by reference.

U.S. Pat. No. 3,991,586, issued Nov. 16, 1976, for "Solenoid Controlled Cold Head for a Cryogenic Cooler" discloses a closed cycle cryogenic cooler, utilizing two solenoids that selectively drive or selectively brake the regenerator-displacer. The physical position of the regenerator-displacer is used to control the actuation of the solenoids. The disclosure of U.S. Pat. No. 3,991,586 is incorporated herein by reference.

In order to achieve maximum cooling efficiency, the pressure/volume diagram ideally should be a perfect rectangle. Stated in terms of the displacer movement, the displacer should commence its movement from TDC when a predetermined pressure differential is reached and should move to BDC without overshooting the BDC position. Similarly, the displacer should be retained at the BDC position until a predetermined pressure differential is reached and then the displacer should move to TDC without overshooting the TDC position.

Application Ser. No. 07/493,474 discloses bi-directional magnetic detents that provide the dual function of snubbing the displacer to limit the amount of overshooting of the TDC and BDC positions and generating a retaining force to keep the displacer at TDC and BDC until a predetermined pressure differential is reached. Although the amount of overshooting of TDC and BDC is significantly limited in this configuration, it should be eliminated entirely.

It is accordingly a general object of the present invention to provide both a method and apparatus for controlling the movement of a free, gas-driven displacer in a cooling engine.

It is a specific object of the invention to utilize both mechanical and magnetic forces to provide the desired controlling action for the free, gas-driven displacer.

It is a further object of the invention to utilize mechanical forces to prevent overshooting and magnetic forces to retain the free, gas-driven displacer until a predetermined pressure differential is reach.

It is a feature of the invention that the method can be practiced and the apparatus constructed utilizing relatively inexpensive and commercially available mechanical and magnetic components.

BRIEF SUMMARY OF THE INVENTION

The present invention employs both mechanical and magnetic forces to control the movement of the displacer. Mechanical stops in the form of crank mechanism prevent axial overshooting of the free, gas-driven displacer in each direction. A uni-directional magnetic "detent" is established at predetermined locations beyond the top dead center and bottom dead center portions of the cooling. Each uni-directional magnetic detent retains the displacer in the magnetic detent until a predetermined pressure differential is reached.

BRIEF DESCRIPTION OF THE DRAWINGS

The objects and features set forth above will best be understood from a detailed description of a preferred embodiment of the invention, selected for purposes of illustration, and shown in the accompanying drawings, in which.

DETAILED DESCRIPTION OF THE INVENTION

Figure 1:
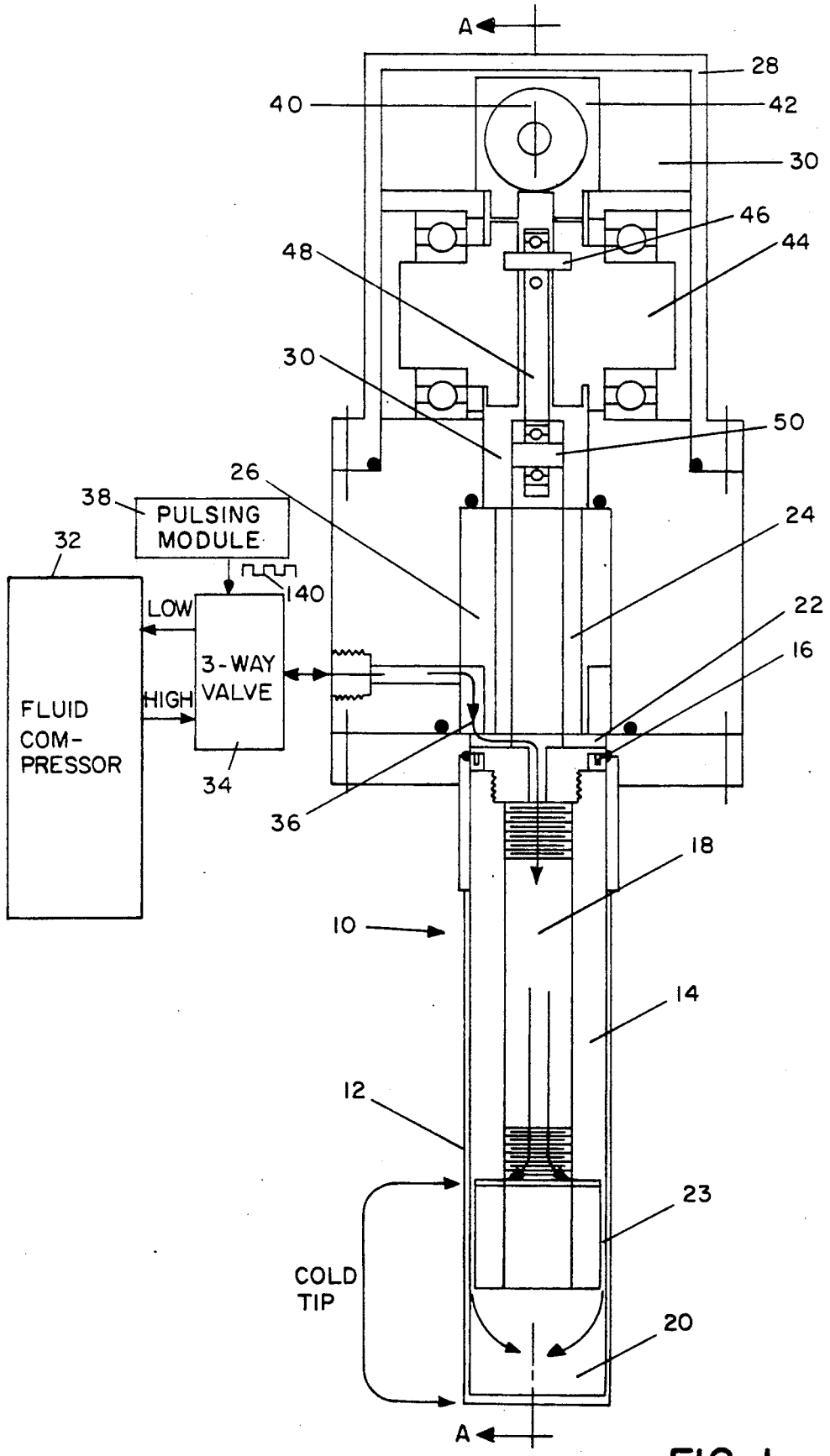
FIG. 1 is a diagrammatic view in side elevation showing a cooling engine having a free, gas-driven displacer, a crank mechanism and magnetic detents with the displacer shown in its TDC position.

Turning now to the drawings, and particularly to FIG. 1 thereof, there is shown in diagrammatic form and side elevation a cooling engine indicated generally by the reference numeral 10. The cooling engine 10 has an expander cylinder 12 within which is located a free, gas-driven displacer 14, having a cylinder wall seal 16. A conventional screen regenerator 18 is located within the displacer to permit bi-directional fluid flow through the displacer. The lower end of cylinder 12 forms the "cold" volume 20 of the cooling engine while the upper end of cylinder 12 forms the "warm" volume 22. An annular gap heat exchanger 23 provides a conduct between the regenerator 18 and the cold volume 20.

The reciprocal movement of the displacer 14 in an up/down direction, as viewed in FIG. 1, is controlled by the differential pressure across a drive piston 24 that is mechanically coupled to the displacer 14. The drive piston 24 slides within a drive cylinder 26 located within a housing 28 that defines a dead-ended drive volume 30 which is at intermediate pressure.

A fluid compressor 32 is fluidly coupled through a three-way valve 34 and passage 36 to the upper end of the displacer 14. A pulsing module 38 produces a square wave control signal 40 for the three-way valve 34. The three-way valve permits alternate pressurization and exhaust of the internal volumes of the displacer in a known manner.

Figure 2:
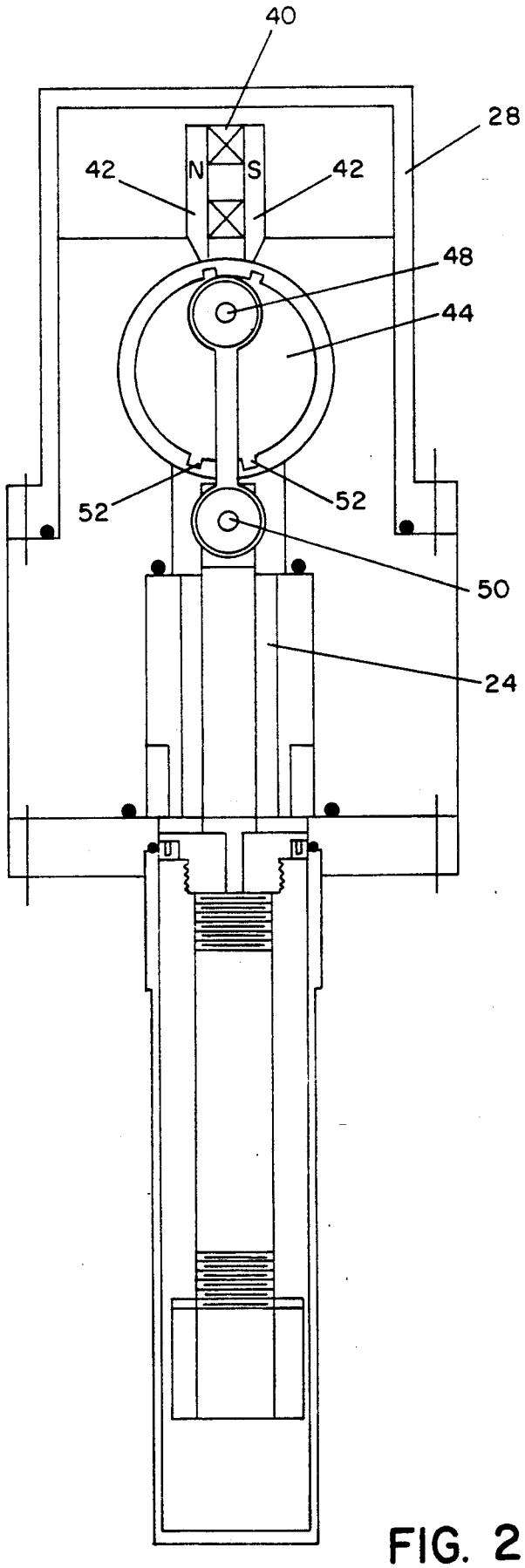
FIG. 2 is a view taken along line A—A of FIG. 1.

Referring now to both FIGS. 1 and 2, there is shown a detent magnet 40 such as a ring-type Samarium cobalt magnet that is magnetized through its axis. Pole pieces 42 are used to concentrate the magnetic flux of the detent magnet. Crank shafts 44 are connected through a crank pin 46 to a connecting rod 48 which in turn is connected through pin 50 to the displacer piston 24. The upper crank pin 46 limits TDC and BDC axial movement of the connecting rod 48. As shown in FIG. 2, each crank shaft 44 has a pair of tooth-shaped magnetic core pieces 52 located on its periphery. The core pieces 52 establish a magnetic "detent" with the previous mentioned pole pieces 42.

Having identified the major components, the displacer cycle operation will now be described. Looking at FIG. 2, both the warm and cold volumes plus the void volume of the regenerator are at a high pressure $P_H$ while the drive volume is at an intermediate pressure $P_I$. The differential pressure across the drive piston has forced the displacer to move to its TDC position. The displacer will stay in this position until the three way valve is actuated and the internal pressures change.

Figure 3:
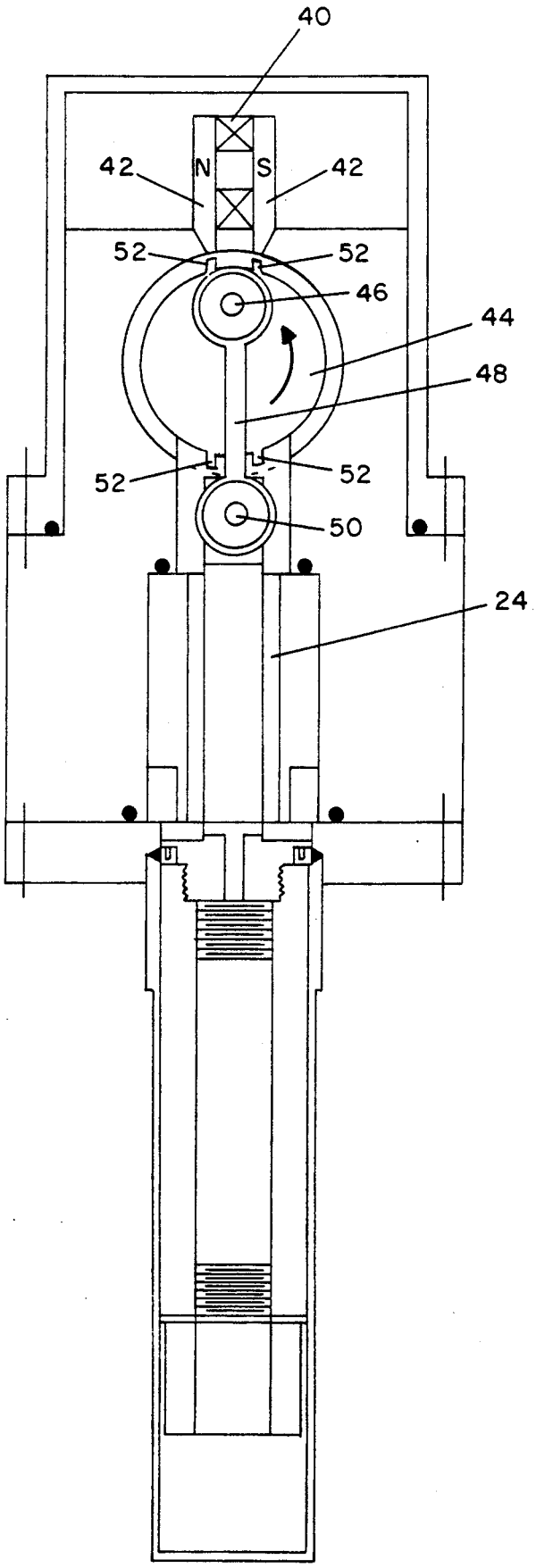
FIG. 3 is a view similar to that of FIG. 2 showing the rotation of the crank mechanism to a magnetic detent position at which the displacer is located axially just beyond its TDC position and towards its BDC position.

In FIG. 3, the electronic pulsing module 38 has just operated the three way valve 34 allowing the high pressure gas to exhaust from the internal volumes of the expander. As the differential pressure across the drive piston 24 decreases, the upward force against the crank pin 46 is no longer high enough to hold the crank shaft at TDC. The magnetic attraction of the pole pieces 42 causes the crank shaft to rotate till the crank shaft magnetic core pieces 52 lock in to the magnetic detent position as shown in FIG. 3. The crank shaft 44, connecting rod 48, drive piston 24 and displacer 14 are held in this detent position during the exhaust portion of the cycle.

Figure 4:
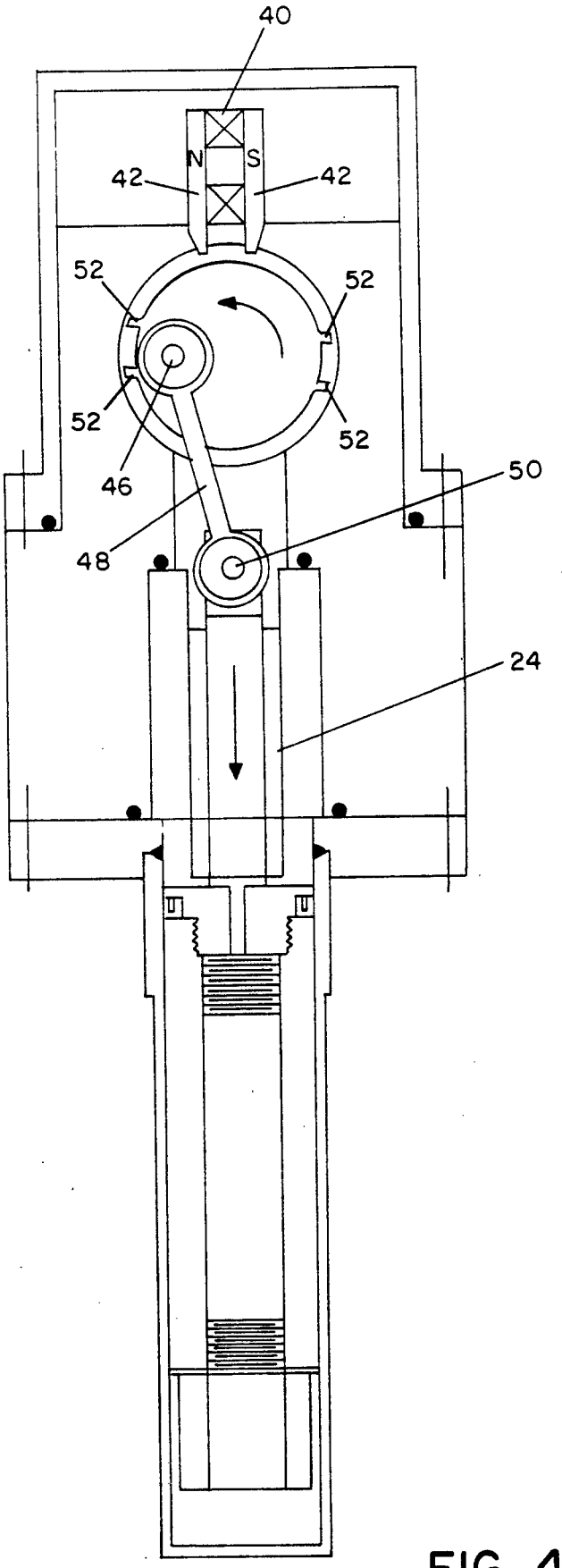
FIG. 4 is a view similar to that of FIG. 3 showing the crank mechanism after it has broken away from the magnetic detent depicted in FIG. 3.

Referring the FIG. 4, the pressure of the internal volumes approaches the low pressure $P_L$. The differential pressure across the drive piston 24 is high enough to overcome the magnetic detent (shown in FIG. 3) between the crank shaft magnetic core pieces 52 and the magnetic pole pieces 42 thus allowing the displacer assembly to move towards the cold end of the cylinder. As the displacer 14 moves downwardly, cold, low pressure gas in volume 20 is displaced upwardly through the regenerator 18 and out o passage 36 to the three way valve 34.

Figure 5:
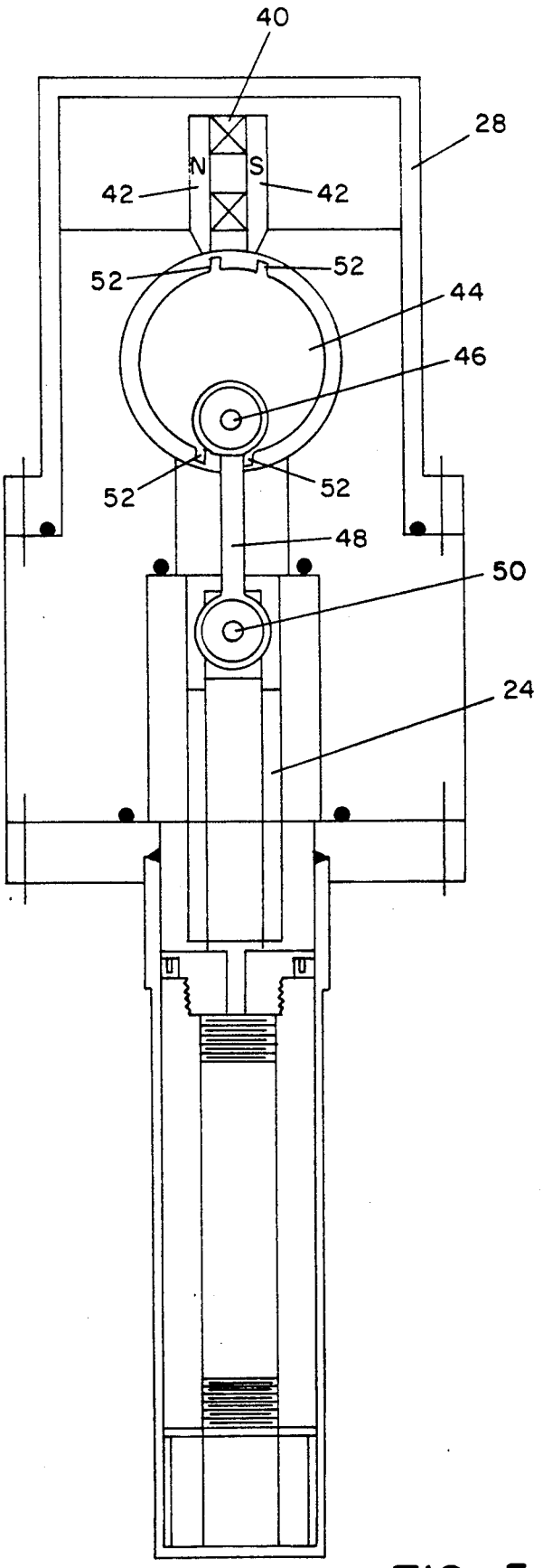
FIG. 5 is a view similar to that of FIG. 4 showing the drive piston, crank mechanism and displacer position at BDC.

In FIG. 5, the displacer 14 has moved to its BDC position. A full downward differential pressure holds the drive piston 24 in this position until the three way valve 34 is actuated. The internal volumes are at a low pressure $P_L$.

Figure 6:
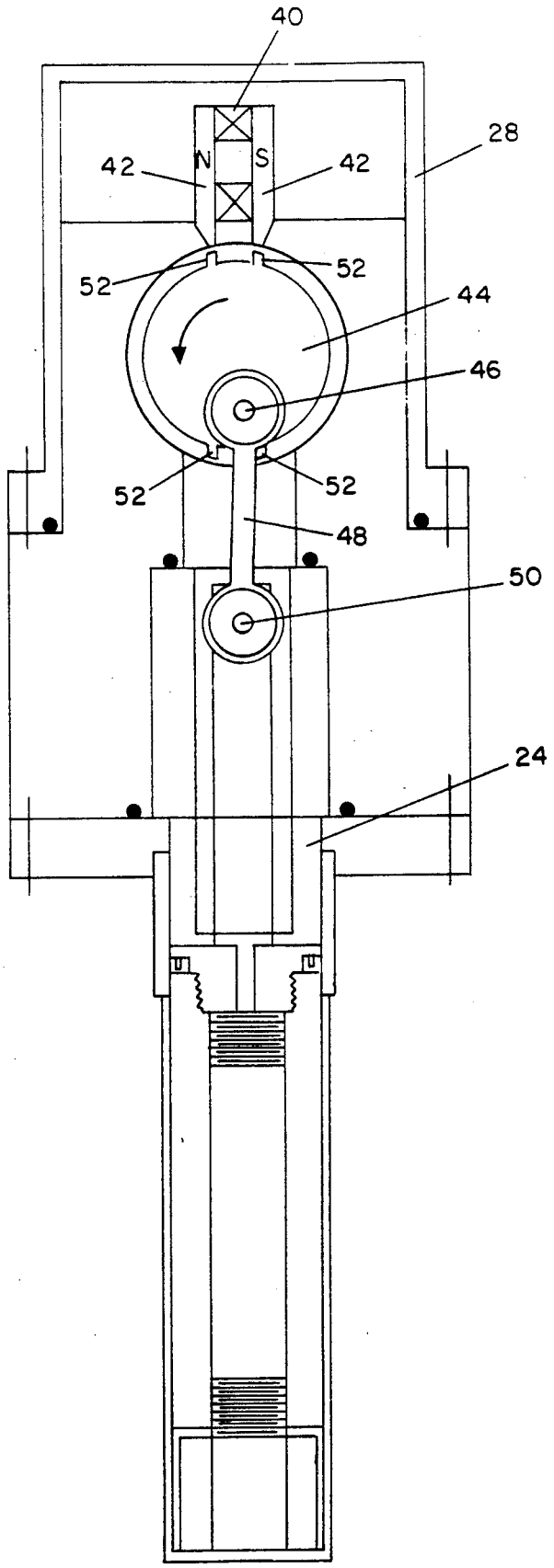
FIG. 6 is a view similar to that of FIG. 5 showing the crank mechanism in a magnetic detent position at which the displacer is located axially just beyond its BDC position and towards its TDC position.

In FIG. 6, the three way valve 34 has just moved to the inlet position allowing high pressure gas to enter passage 36. As the differential pressure across the drive piston 24 decreases, the downward force against the crank pin 46 is no longer high enough to hold the crank shaft at BDC. The magnetic attraction of the crank shaft magnetic cores 52 to the pole pieces 42 causes the crank shaft to rotate to the detent position shown in FIG. 6.

Figure 7:
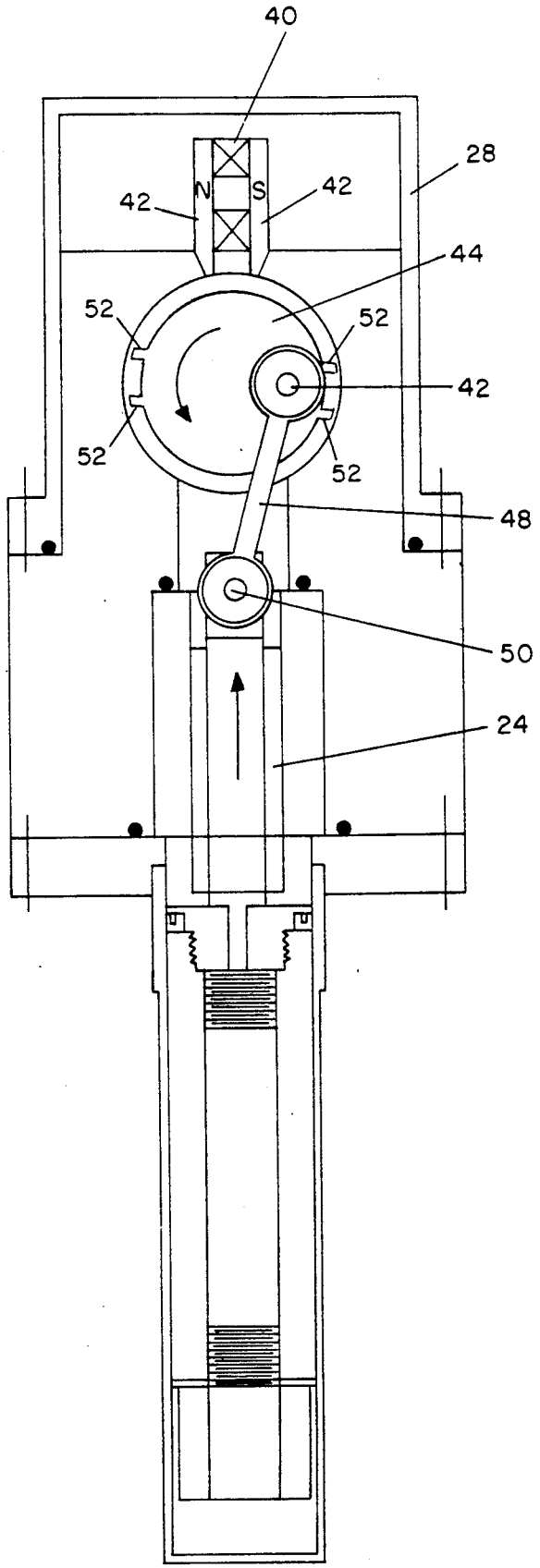
FIG. 7 is a view similar to that of FIG. 6 showing the crank mechanism rotating towards the TDC position shown in FIG. 2.

Looking at FIG. 7, after the predetermined differential pressure is achieved, the magnetic detent is broken and the displacer, and drive piston move upwardly as the crank shaft 44 rotates in a counter clockwise direction until the position shown in FIG. 3 is reached.

Figure 8:
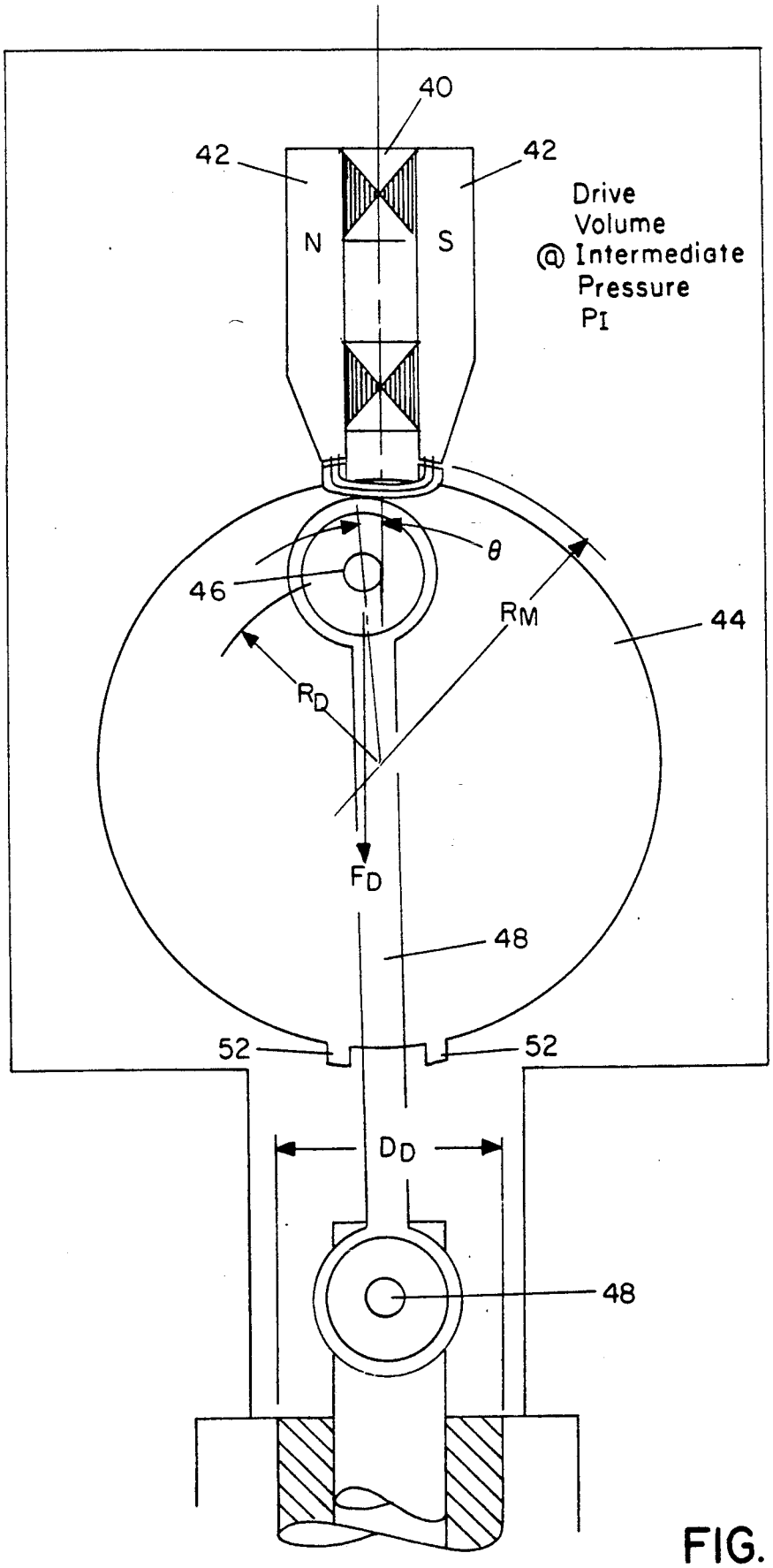
FIG. 8 is an enlarged view showing the distance and angular relationships of the crank shaft, connecting rod and drive piston; and, FIG. 9 is a force diagram.

Referring now to FIG. 8, there is illustrated in enlarged view the magnetic elements, crank shaft, connecting rod and drive piston. These components are depicted with the drive volume at an intermediate pressure $P_I$. As shown in FIG. 8, $R_M$=the radius of the magnetic cores; $R_D$=the radius of the crank pin; $D_D$=the diameter of the drive piston angle; 0=the offset angle between the vertical position of the connecting rod's longitudinal axis and the position of the longitudinal axis of the connecting rod at the magnetic detent; $F_D$=the vertical force of the drive piston; $P_{CH}$=the pressure on the bottom side of the drive piston; and, $P_I$=pressure on the top side of the drive piston.

$F_M$ is the force needed to break the magnetic couple between the magnetic pole pieces 42 and the crank shaft magnetic core pieces 52. This force act on the crank shaft at a radius $R_M$ producing a torque $T_M$ where $F_M \times R_M = T_M$ is the torque needed to break the magnetic couple. The drive force $F_D$ is the product of, the differential pressure between the internal pressure of the cold head and the intermediate pressure drive volume $P_I$ and the drive piston area $A_D$ where $A_D = D_D^2$; $F_D = (P_{CH} - P_I) \times A_D$.

Figure 9:
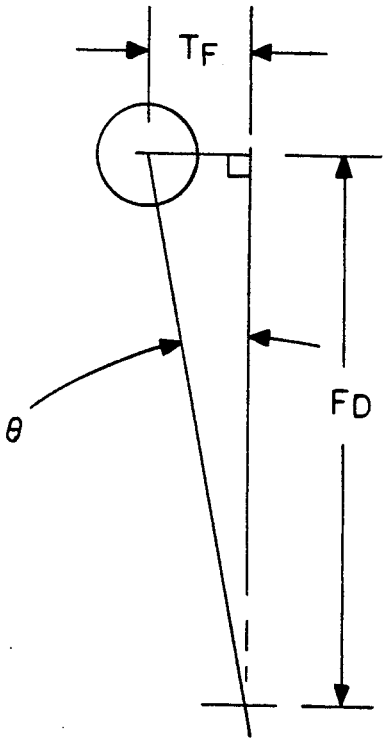

Referring to FIG. 9, the tangential force, $T_F$ on the drive crank pin 46 is the product of the drive force $F_D$ and the Sin 0 where $T_F = \text{Sin } 0 \times F_D$. Therefore the forces acting on the crank shaft is the sum of the crank pin forces and the magnetic couple force. $T_M = T_F$ where $F_M \times R_M = \text{Sin } 0 \times (P_{CH} - P_I) \times A_D$.

Having described in detail a preferred embodiment of the invention, it will now be apart to those skilled in the art that numerous modifications can be made therein without departing from the scope of the invention as defined in the following claims. For example, the magnets and cores can be interchanged so that the magnet is located on the crank shaft while the cores are stationary.

What I claim and desire to secure by Letters Patent of the United State is:

1. A method for controlling the movement of a free motion, gas-driven, piston actuated displacer with respect to the top dead center and bottom dead center portions of its cycle in a cooling engine, said method comprising the steps of:

(1) generating a mechanical stopping force that acts on the displacer to prevent the axial movement of the displacer beyond top dead center;

(2) generating another mechanical stopping force that acts on the displacer to prevent axial the movement of the displacer beyond bottom dead center;

(3) generating a magnetic retaining force that acts on the displacer to prevent the displacer from moving towards bottom dead center until a first predetermined pressure differential is established across the displacer's actuation piston; and, (4) generating a magnetic retaining force that acts on the displacer to prevent the displacer from moving towards top dead center until a second predetermined pressure differential is established across the displacer's actuation piston.

2. The method of claim 1 wherein said magnetic retaining forces are of equal magnitude.

3. The method of claim 1 wherein said magnetic retaining forces are unequal magnitude.

4. The method of claim 1 wherein said mechanical stopping forces are generated by a crank shaft that is mechanically coupled to the displacer's actuation piston.

5. The method of claim 1 wherein said magnetic retaining forces are generated by means of a magnetic couple between magnetic pole pieces and a magnetic core.

6. The method of claim 5 wherein the magnetic core is located an said crank shaft.

7. The method of claim 6 wherein the magnetic pole pieces are located on said crank shaft.

8. In a cooling engine having a free, gas-driven displacer and drive piston, the improvement comprising:

A. means defining a first mechanical stop to prevent the displacer from moving axially beyond top dead center;

B. means defining a second mechanical stop to prevent the displacer from moving axially beyond bottom dead center;

C. means defining a first uni-directional magnetic detent, said first magnetic detent generating:

a first magnetic retaining force that acts on the displacer to prevent the displacer from moving towards bottom dead center until a predetermined pressure differential is established across the displacer's drive piston; and, D. means defining a second uni-directional magnetic detent, said second magnetic detent generating:

a second magnetic retaining force that acts on the displacer to prevent the displacer from moving towards top dead center until a predetermined pressure differential is established across the displacer's drive piston.

9. In a cooling engine having a free, gas-driven displacer and drive piston, the improvement comprising:

A. means defining (i) a first mechanical stop to prevent the displacer from moving axially beyond top dead center; and (ii) a second mechanical stop to prevent the displacer from moving axially beyond bottom dead center;

B. means defining a first uni-directional magnetic detent, said first magnetic detent generating:

a first magnetic retaining force that acts on the displacer to prevent the displacer from moving towards bottom dead center until a predetermined pressure differential is established across the displacer's drive piston; and, C. means defining a second uni-directional magnetic detent, said second magnetic detent generating:

a second magnetic retaining force that acts on the displacer to prevent the displacer from moving towards top dead center until a predetermined pressure differential is established across the displacer's drive piston.

10. The cooling engine of claim 9 wherein said means for defining said first and second mechanical stops comprises crank means mechanically coupled to the drive piston of the displacer.

11. The cooling engine of claim 10 wherein said crank means includes a crank shaft and connecting rod means mechanically connected to said crank shaft and to said drive piston.

12. The cooling engine of claims 11 wherein said means defining a first uni-directional magnetic detent comprised a first magnetic core and first magnetic pole pieces that are operational connected to the crank shaft so that rotation of the crank shaft produces relative movement between the first magnetic core and the first magnetic pole pieces.

13. The cooling engine of claim 12 wherein the first magnetic core is located on the crank shaft.

14. The cooling engine of claim 12 wherein the first magnetic pole pieces are located on the crank shaft.

15. The cooling engine of claims 11 wherein said means defining a second uni-directional magnetic detent comprised a second magnetic core and second magnetic pole pieces that are operationally connected to the crank shaft s that rotation of the crank shaft produces relative movement between the second magnetic core and the second magnetic pole pieces.

16. The cooling engine of claim 15 wherein the second magnetic core is located on the crank shaft.

17. The cooling engine of claim 15 wherein the second magnetic pole pieces are located on the crank shaft.

* * * * *